US010673162B2

(12) United States Patent
Huang

(10) Patent No.: US 10,673,162 B2
(45) Date of Patent: Jun. 2, 2020

(54) ELECTRICAL CONNECTOR

(71) Applicant: LOTES CO., LTD, Keelung (TW)

(72) Inventor: Chang Wei Huang, Keelung (TW)

(73) Assignee: LOTES CO., LTD, Keelung (TW)

( * ) Notice: Subject to any disclaimer, the term of this patent is extended or adjusted under 35 U.S.C. 154(b) by 0 days.

(21) Appl. No.: 16/295,121

(22) Filed: Mar. 7, 2019

(65) Prior Publication Data

US 2019/0280415 A1 Sep. 12, 2019

(30) Foreign Application Priority Data

Mar. 9, 2018 (CN) ..... 2018 1 0192185
Mar. 30, 2018 (CN) ..... 2018 1 0287000

(51) Int. Cl.

| | |
|---|---|
| ***H01R 13/24*** | (2006.01) |
| ***H01R 4/02*** | (2006.01) |
| ***H01R 12/52*** | (2011.01) |
| ***H01R 12/55*** | (2011.01) |
| ***H01R 12/70*** | (2011.01) |
| ***H01R 13/40*** | (2006.01) |

(Continued)

(52) U.S. Cl.

CPC ..... *H01R 13/2464* (2013.01); *H01R 4/02* (2013.01); *H01R 12/52* (2013.01); *H01R 12/55* (2013.01); *H01R 12/707* (2013.01); *H01R 12/7076* (2013.01); *H01R 12/714* (2013.01); *H01R 13/2407* (2013.01); *H01R 13/2442* (2013.01); *H01R 13/40* (2013.01); *H01R 13/41* (2013.01); *H01R 13/502* (2013.01); *H01R 13/514* (2013.01); *H01R 13/6461* (2013.01); *H01R 13/6473* (2013.01); *H01R 33/74* (2013.01)

(58) Field of Classification Search

CPC ..... H01R 13/24; H01R 4/02; H01R 12/52; H01R 12/707
USPC ..... 439/660
See application file for complete search history.

(56) References Cited

U.S. PATENT DOCUMENTS 7,264,486 B2 * 9/2007 Ma ..... H01R 13/2442 439/83
7,303,421 B2 * 12/2007 Liao ..... H01R 4/02 439/342

(Continued)

FOREIGN PATENT DOCUMENTS

| | | |
|---|---|---|
| CN | 201478523 U | 5/2010 |
| CN | 201797121 U | 4/2011 |
| CN | 202997129 U | 6/2013 |

*Primary Examiner* — Alexander Gilman
(74) *Attorney, Agent, or Firm* — Locke Lord LLP; Tim Tingkang Xia, Esq.

(57) ABSTRACT

An electrical connector is used for electrically connecting a chip module to a circuit board, and includes an insulating body provided with at least one accommodating slot, and at least one terminal provided in the at least one accommodating slot. The terminal has a first base and a second base formed by bending from the first base. An elastic arm is formed by bending upward and extending from the first base. The elastic arm is provided with a contact portion to be conductively connected with the chip module. The first base has a retaining portion located at a lower end thereof and extending downward. The retaining portion fits with the at least one accommodating slot to retain the terminal in the insulating body. A conducting portion extends downward from the second base to be conductively connected with the circuit board.

20 Claims, 14 Drawing Sheets

(51) Int. Cl.

| | |
|---|---|
| ***H01R 13/502*** | (2006.01) |
| ***H01R 13/514*** | (2006.01) |
| ***H01R 13/6473*** | (2011.01) |
| ***H01R 12/71*** | (2011.01) |
| ***H01R 13/41*** | (2006.01) |
| ***H01R 13/6461*** | (2011.01) |
| ***H01R 33/74*** | (2006.01) |

(56) References Cited

U.S. PATENT DOCUMENTS

| | | | | |
|---|---|---|---|---|
| 7,578,675 | B2 * | 8/2009 | Polnyl | H01R 12/57 439/66 |
| 7,628,661 | B2 * | 12/2009 | Liao | H01R 12/57 439/862 |
| 7,632,105 | B2 * | 12/2009 | Yan | H01R 13/428 439/66 |
| 8,187,009 | B2 * | 5/2012 | Liao | H01R 12/57 439/83 |
| 8,454,373 | B2 * | 6/2013 | Cheng | H01R 12/57 439/66 |
| 2005/0020098 | A1 * | 1/2005 | Ramey | H01R 13/2442 439/66 |
| 2012/0178298 | A1 * | 7/2012 | Jin | H01R 12/714 439/626 |
| 2012/0178306 | A1 * | 7/2012 | Ju | H01R 12/57 439/660 |
| 2012/0196481 | A1 * | 8/2012 | Ju | H01R 13/6588 439/626 |
| 2013/0183861 | A1 * | 7/2013 | Chang | H05K 7/1069 439/607.35 |
| 2014/0038438 | A1 * | 2/2014 | Chang | H01R 12/71 439/76.1 |

* cited by examiner

ELECTRICAL CONNECTOR

CROSS-REFERENCE TO RELATED PATENT APPLICATION

This non-provisional application claims priority to and the benefit of, pursuant to 35 U.S.C. § 119(a), patent application Serial No. CN201810192185.9, filed in China on Mar. 9, 2018, and patent application Serial No. CN201810287000.2, filed in China on Mar. 30, 2018. The disclosures of the above applications are incorporated herein in their entireties by reference.

Some references, which may include patents, patent applications and various publications, are cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference were individually incorporated by reference.

FIELD

The present invention relates to an electrical connector, and more particularly to an electrical connector providing a more stable electrical connection between a terminal and a chip module

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

A conventional electrical connector in the industry is used for electrically connecting a chip module to a circuit board. The electrical connector has an insulating body and a plurality of conductive terminals. The insulating body is provided with a plurality of accommodating holes for correspondingly accommodating the conductive terminals. The basic structure of each conductive terminal includes a flat main body portion, an elastic arm bending upward and extending from the main body portion, and a soldering portion extending downward from the main body portion, where a contact portion is provided on the elastic arm for making contact with the chip module. A base laterally bends and extends from the main body portion, where two sides of a lower end of the base is provided with clamping points in interference fit with the wall of the accommodating hole. The main body portion is suspended, such that each conductive terminal is fixed to the insulating body. A strip connecting portion extends upward from the base.

However, when a conductive terminal with such a structure is accommodated in the accommodating hole, a portion of the base that is fixed to the insulating body is located far away from the contact portion and located at a side the main body portion. Thus, when the contact portion is subjected to an external force, the contact portion is likely to shake in a left-right direction, thereby affecting a stable electrical connection between the electrical connector and the chip module.

Therefore, a heretofore unaddressed need to design an improved electrical connector exists in the art to address the aforementioned deficiencies and inadequacies.

SUMMARY

In view of the problems in the background, the present invention is directed to an electrical connector, which provides, on a base connected below the elastic arm, a retaining portion in interference fit with an insulating body, such that the lower end of an elastic arm is fixed, so as to prevent a contact portion on the elastic arm to be applied with a force and have excessive shake, thereby providing a more stable electrical connection between a terminal and a chip module.

To achieve the foregoing objective, the present invention adopts the following technical solutions.

An electrical connector is configured to electrically connecting a chip module to a circuit board, including: an insulating body, provided with at least one accommodating slot; and at least one terminal, provided in the at least one accommodating slot, wherein the at least one terminal has a first base and a second base located at one side of the first base, the first base and the second base are located on different planes and form an angle therebetween, the first base is in interference fit with the at least one accommodating slot to retain the at least one terminal in the insulating body, an elastic arm is formed by bending upward and extending from the first base, the elastic arm is provided with a contact portion configured to be conductively connected with the chip module, and a conducting portion extends downward from the second base to be conductively connected with the circuit board.

In certain embodiments, the first base has a retaining portion located at a lower end thereof, and the retaining portion is configured to retain the at least one terminal in the at least one accommodating slot.

In certain embodiments, the conducting portion has a flexible arm extending from a lower end of the second base and a soldering portion extending from a tail end of the flexible arm, and the conducting portion and the first base are located at a same side of a plane where the second base is located.

In certain embodiments, the flexible arm extends downward obliquely from the second base along a straight line.

In certain embodiments, the flexible arm bends from the lower end of the second base and then extends downward vertically, and the flexible arm and the retaining portion maintain an interval therebetween in a horizontal direction.

In certain embodiments, the soldering portion is pre-filled with a solder, the insulating body is provided with a stopping block formed in the at least one accommodating slot and protruding toward the at least one accommodating slot, the stopping block is configured to stop the solder from moving upward, and the stopping block is provided to directly face the flexible arm in a horizontal direction.

In certain embodiments, each of a side edge of the first base and a side edge of the second base is respectively provided with a position limiting portion, the at least one accommodating slot is correspondingly provided with a retention portion corresponding to each of the position limiting portions, and the retention portions are configured to stop the position limiting portions and to prevent the at least one terminal from moving downward.

In certain embodiments, a strip connecting portion is formed by extending upward from the second base and is configured to be connected to a strip, an upper surface of the insulating body is provided with at least one supporting block configured to support the chip module, and the supporting block is located at one side of the at least one accommodating slot and close to the strip connecting portion.

In certain embodiments, a reserved slot is concavely provided on the at least one accommodating slot to provide an elastic deformation space for the conducting portion.

Compared with the related art, certain embodiments of the present invention have the following beneficial effects.

By providing, on the first base connected to the elastic arm, the retaining portion in interference fit with the accommodating slot, the first base is prevented from being suspended. When the chip module downward presses a contact portion provided on the elastic arm, or an impact of external forces is caused when they are mated, the contact portion is prevented from excessive shake in a left-right direction, thereby ensuring the stability of an electrical connection between the electrical connector and the chip module.

An electrical connector is configured to electrically connecting a chip module to a circuit board, including: an insulating body, provided with at least one accommodating slot; and at least one terminal, provided in the at least one accommodating slot, wherein the at least one terminal has a first base and a second base formed by bending from the first base, an elastic arm is formed by bending upward and extending from the first base, the elastic arm is provided with a contact portion configured to be conductively connected with the chip module, the first base has a retaining portion located at a lower end thereof and extending downward, the retaining portion fits with the at least one accommodating slot to retain the at least one terminal in the insulating body, and a conducting portion extends downward from the second base to be conductively connected with the circuit board.

In certain embodiments, the first base has a connecting portion located at an upper end thereof, the connecting portion is provided with a slot, and a height of the slot in a vertical direction is not greater than one half of a height of the first base.

In certain embodiments, each of a side edge of the first base and a side edge of the second base is respectively provided with a position limiting portion, the at least one accommodating slot is correspondingly provided with a retention portion corresponding to each of the position limiting portions, and the retention portions are configured to stop the position limiting portions to prevent the at least one terminal from moving downward.

In certain embodiments, a bending portion is formed between the first base and the second base, one side of the retaining portion extends toward the second base, and a gap is provided between the retaining portion and the bending portion in a vertical direction.

In certain embodiments, the insulating body is provided with a stopping portion formed in the at least one accommodating slot and protruding toward the at least one accommodating slot, and the stopping portion is configured to stop the bending portion and to prevent the at least one terminal from moving downward.

In certain embodiments, the retaining portion is retained between the stopping portion and a slot wall of the at least one accommodating slot.

In certain embodiments, the at least one accommodating slot has a first groove, a slot wall of the at least one accommodating slot is protrudingly provided with a rib, a second groove is formed between the rib and an adjacent slot wall of the at least one accommodating slot, the retaining portion is retained in the first groove, and the second base is retained in the second groove.

Compared with the related art, certain embodiments of the present invention have the following beneficial effects.

By providing the retaining portion at the lower end of the first base, and the retaining portion fitting with the slot walls of the accommodating slot to retain the terminal in the insulating body, the first base is prevented from being suspended. When the chip module downward presses a contact portion provided on the elastic arm, or an impact of external forces is caused when they are mated, the contact portion is prevented from excessive shake in a left-right direction, thereby ensuring the stability of an electrical connection between the electrical connector and the chip module.

An electrical connector is configured to electrically connecting a chip module to a circuit board, including: an insulating body, provided with at least one accommodating slot; and at least one terminal, provided in the at least one accommodating slot, wherein the at least one terminal has a first base and a second base formed by bending from one side of the first base, an elastic arm is formed by bending upward and extending from the first base, the elastic arm is provided with a contact portion configured to be conductively connected with the chip module, the first base has a retaining portion located at a lower end thereof, the retaining portion is in interference fit with the at least one accommodating slot to retain the at least one terminal in the insulating body, a flexible arm is formed by extending downward from the second base, a soldering portion is formed by extending from a tail end of the flexible arm, and the soldering portion is configured to be soldered to the circuit board.

In certain embodiments, a bending portion is formed between the first base and the second base, one side of the retaining portion extends toward the second base, and a gap is provided between the retaining portion and the bending portion in a vertical direction.

In certain embodiments, the flexible arm extends downward obliquely from the second base along a straight line, and the flexible arm and the first base are located at a same side of the second base.

In certain embodiments, the flexible arm bends from the lower end of the second base and then extends downward vertically, the flexible arm and the retaining portion maintain an interval therebetween in a horizontal direction, and the flexible arm and the first base are located at a same side of the second base.

Compared with the related art, certain embodiments of the present invention have the following beneficial effects.

By providing, at the lower end of the first base connected to the elastic arm, the retaining portion in interference fit with the accommodating slot, the first base is prevented from being suspended. When the chip module downward presses a contact portion provided on the elastic arm, or an impact of external forces is caused when they are mated, the contact portion is prevented from excessive shake in a left-right direction, thereby ensuring the stability of an electrical connection between the electrical connector and the chip module. Further, the flexible arm is provided below the second base, and the soldering portion extends from the tail end of the flexible arm. When the soldering portion is soldered to the circuit board by a solder, the flexible arm provides flexibility, which may effectively prevent the occurrence of solder cracking between the electrical connector and the circuit board due to stress.

These and other aspects of the present invention will become apparent from the following description of the preferred embodiment taken in conjunction with the following drawings, although variations and modifications therein may be effected without departing from the spirit and scope of the novel concepts of the disclosure.

BRIEF DESCRIPTION OF THE DRAWINGS

The accompanying drawings illustrate one or more embodiments of the disclosure and together with the written description, serve to explain the principles of the disclosure. Wherever possible, the same reference numbers are used throughout the drawings to refer to the same or like elements of an embodiment, and wherein.

DETAILED DESCRIPTION

Figure 1:
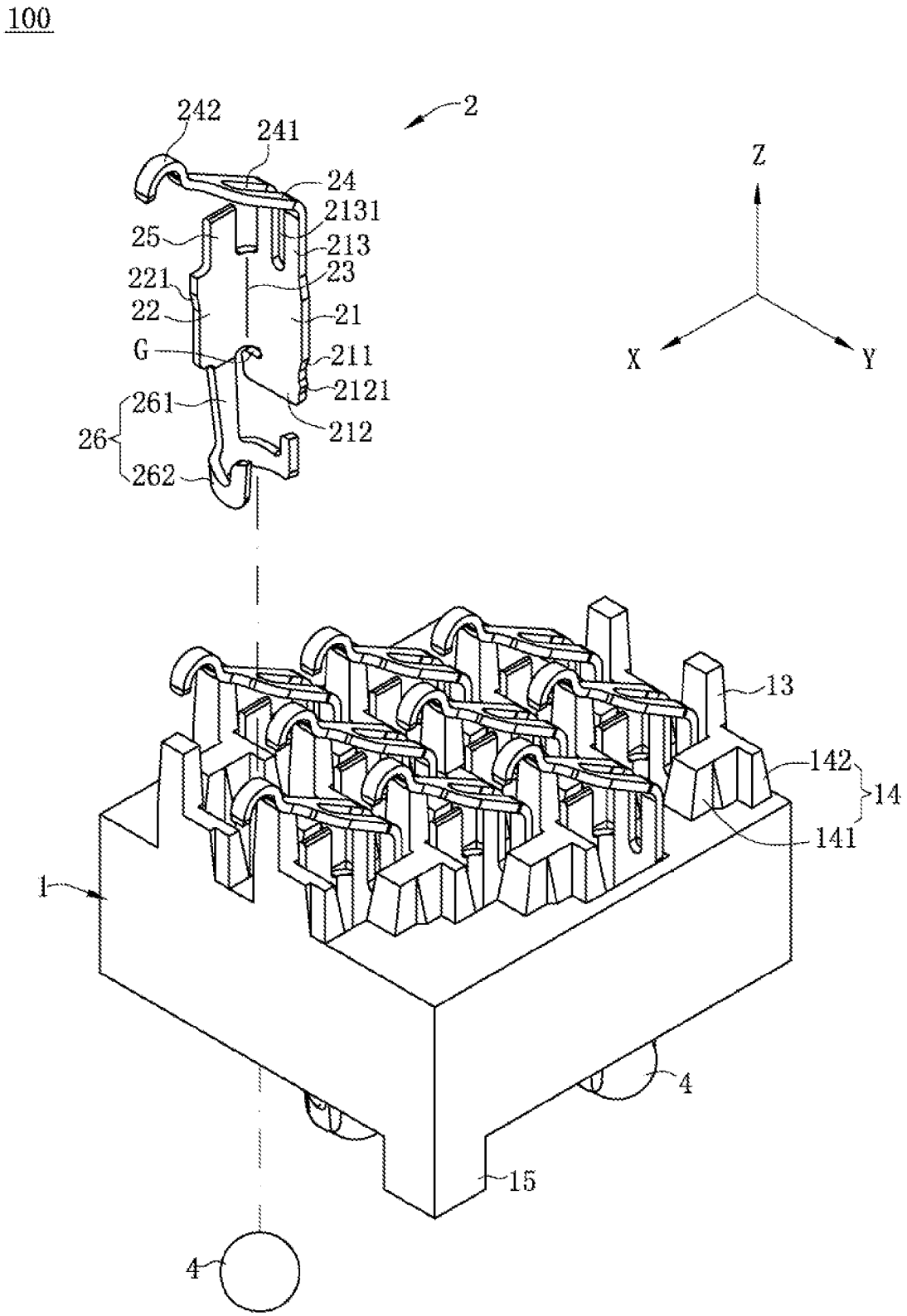
FIG. 1 is a perspective exploded view of an electrical connector according to a first embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-14. In accordance with the purposes of this invention, as embodied and broadly described herein, this invention, in one aspect, relates to an electrical connector.

FIG. 1 to FIG. 7 show an electrical connector according to a first embodiment of the present invention. The electrical connector 100 of the present invention is used for electrically connecting a chip module 200 to a circuit board 300, and the electrical connector 100 includes an insulating body 1 and a plurality of terminals 2 provided on the insulating body 1.

Figure 3:
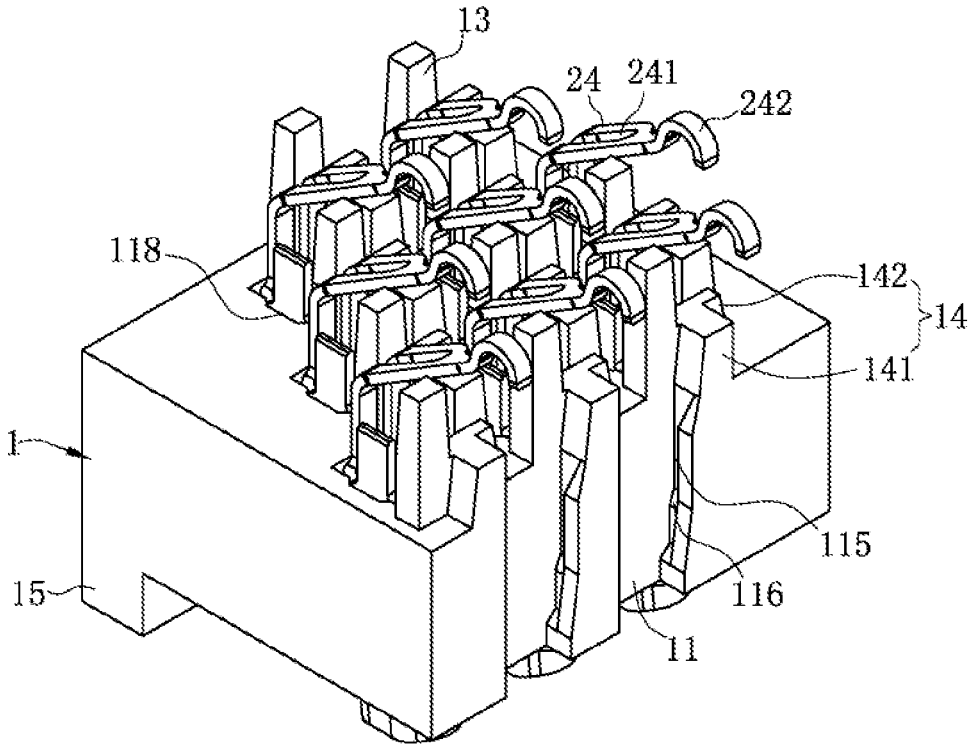
FIG. 3 is a perspective assembled sectional view of FIG. 1 from another viewing angle.
Figure 4:
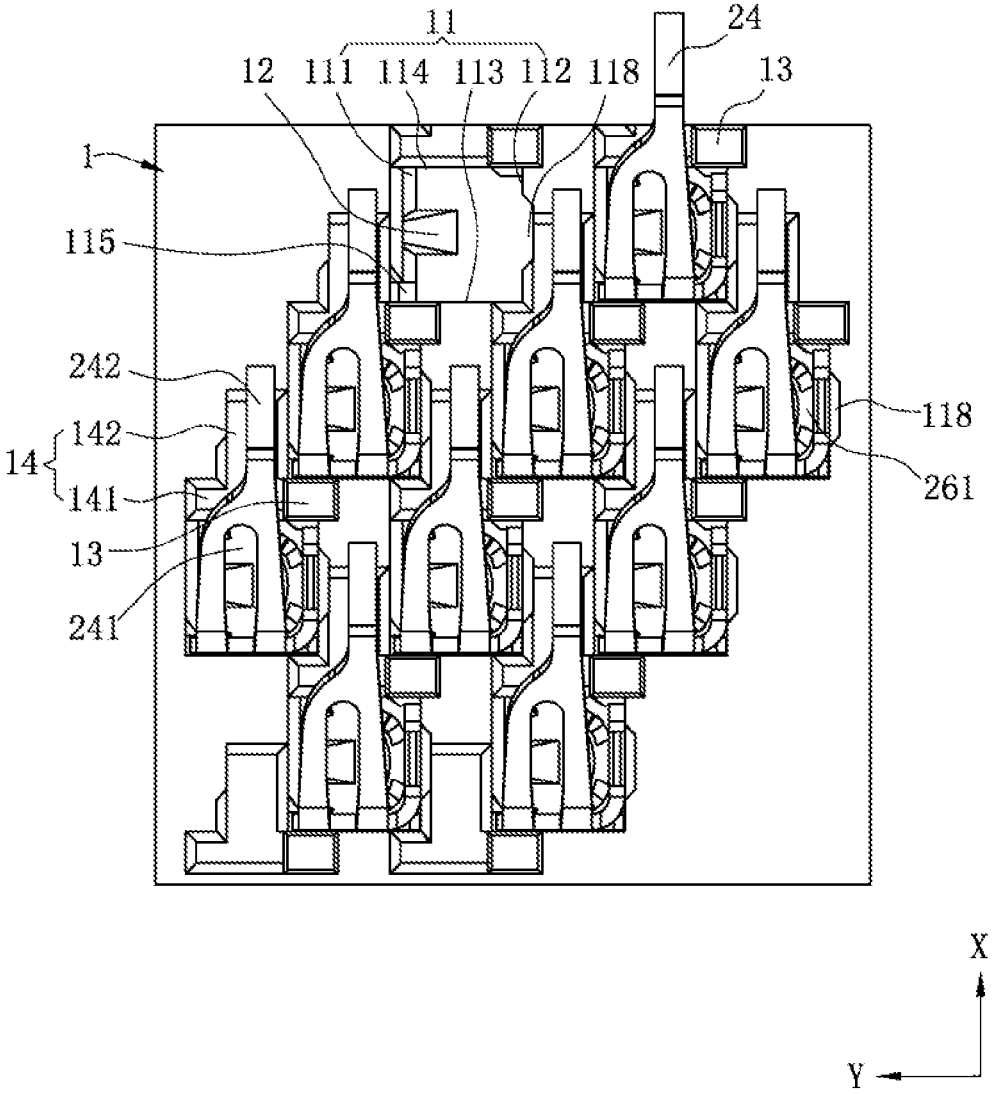
FIG. 4 is a top view of an electrical connector according to the first embodiment of the present invention.

As shown in FIG. 1, FIG. 3, and FIG. 4, an X axis is defined as a front-rear direction, a Y axis is defined as a left-right direction, and a Z axis is defined as a vertical direction. The insulating body 1 is provided with a plurality of accommodating slots 11 penetrating through an upper surface and a lower surface thereof. The accommodating slots 11 are provided in multiple rows in the front-rear direction, and the accommodating slots 11 in two adjacent rows are staggeredly provided. Each accommodating slot 11 has a first slot wall 111, a second slot wall 112, and a third slot wall 113 and a fourth slot wall 114 connected to the first slot wall 111 and the second slot wall 112. The first slot wall 111 and the second slot wall 112 are opposite to each other in the left-right direction, and the third slot wall 113 and the fourth slot wall 114 are opposite to each other in the front-rear direction. Each accommodating slot 11 has a first groove 115 concavely formed on the first slot wall 111. The first groove 115 is adjacent to the third slot wall 113, and the first groove 115 penetrates upward through the upper surface of the insulating body 1 and does not penetrate through the lower surface of the insulating body 1. A first retention portion 116 is formed on the wall of the first groove 115.

Figure 6:
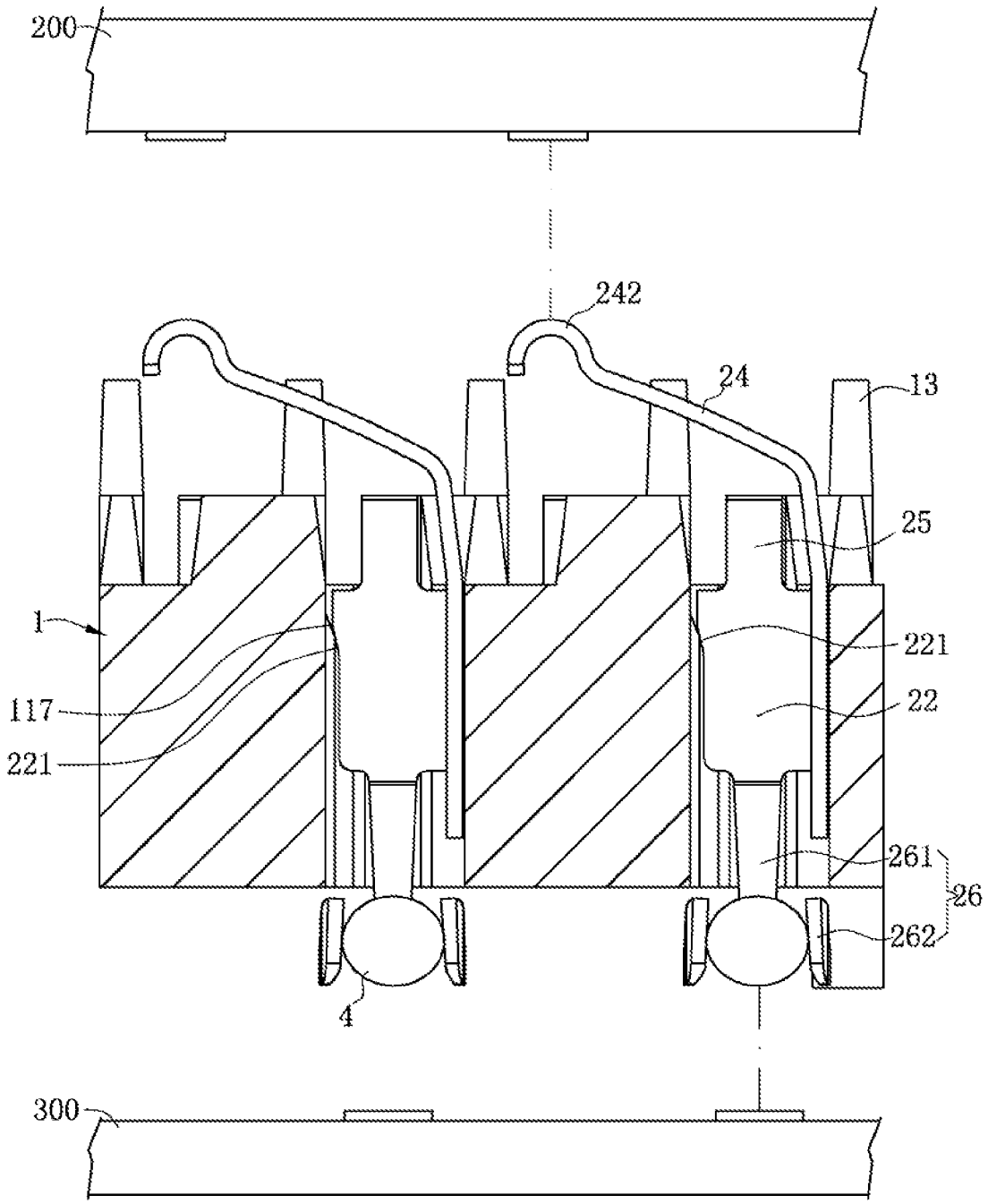
FIG. 6 is an exploded sectional view of an electrical connector for connecting a chip module and a circuit board in FIG. 1.
Figure 7:
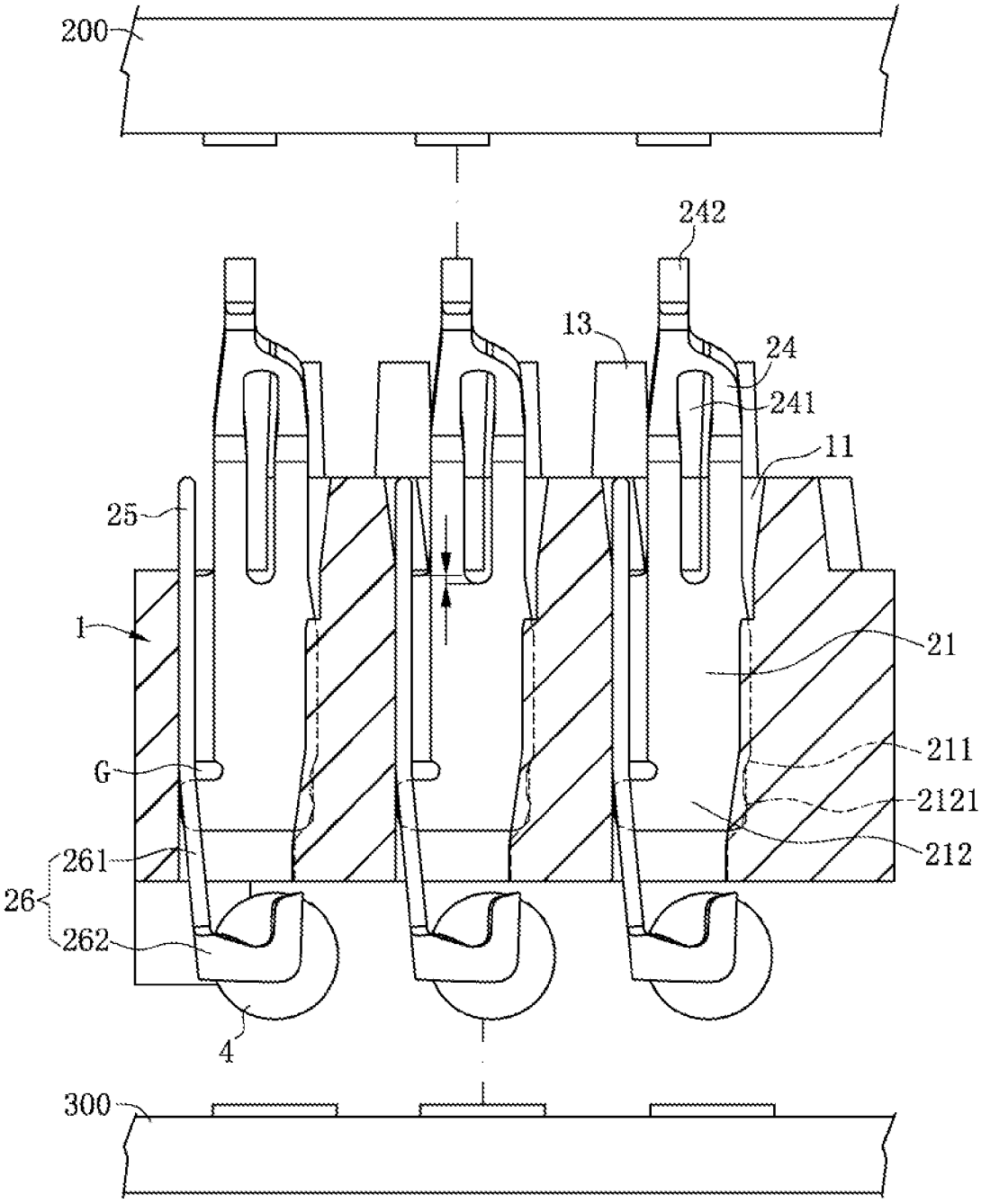
FIG. 7 is an exploded sectional view of FIG. 6 from another viewing angle.

As shown in FIG. 6 and FIG. 7, the fourth slot wall 114 forms a second retention portion 117. In the present embodiment, both the first retention portion 116 and the second retention portion 117 are plain surfaces obliquely upward.

Figure 2:
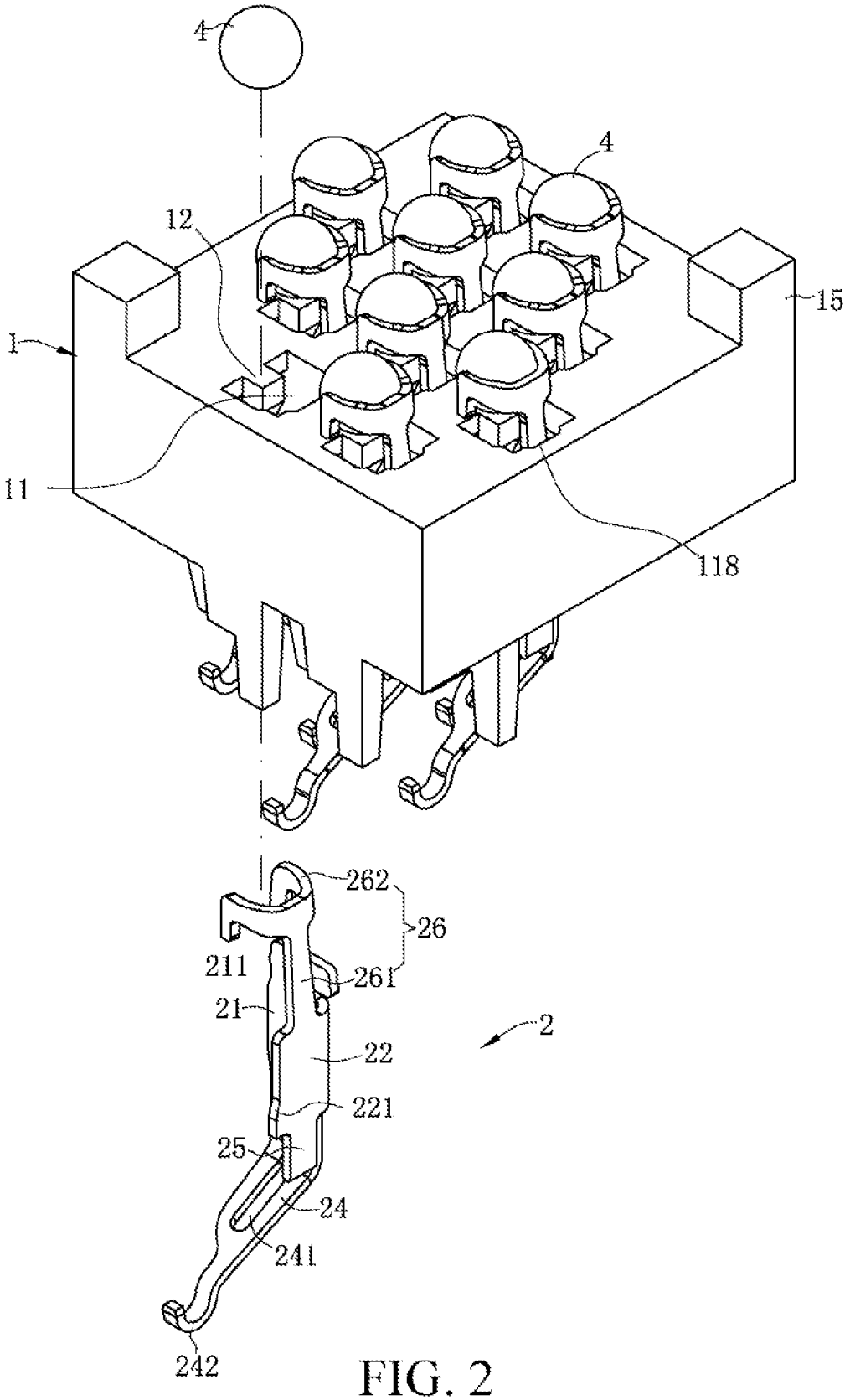
FIG. 2 is an inverted perspective exploded view of FIG. 1.

As shown in FIG. 2, FIG. 3, and FIG. 4, the accommodating slot 11 has a reserved slot 118 concavely formed from the second slot wall 112. The reserved slot 118 penetrates through the upper surface and the lower surface of the insulating body 1. The insulating body 1 also has a stopping block 12 protruding from the first slot wall 111 to the accommodating slot 11. The stopping block 12 is located at the lower end of the accommodating slot 11, and directly faces the reserved slot 118 horizontally in the left-right direction.

As shown in FIG. 1 and FIG. 4, the upper surface of the insulating body 1 is provided with a plurality of supporting blocks 13 for supporting the chip module 200. In the present embodiment, each accommodating slot 11 is correspondingly provided with one supporting block 13, and the supporting block 13 is located in front of the fourth slot wall 114 and close to the second slot wall 112. The insulating body 1 also has a plurality of protruding blocks 14 protruding upward from the upper surface thereof. Each protruding block 14 is connected to the left side of the corresponding supporting block 13. A height of the protruding block 14 is less than a height of the supporting block 13, and the supporting block 13 and the protruding block 14 connected thereto stretch across the width of the corresponding accommodating slot 11 in the left-right direction. Some of the protruding blocks 14 include a first protruding block 141 and a second protruding block 142 connected to each other. The first protruding block 141 is connected to the corresponding supporting block 13 and located between the accommodating slots 11 in two adjacent rows in the front-rear direction, and the second protruding block 142 is located between two adjacent accommodating slots 11 in the same row. Other protruding blocks 14 include only the first protruding block 141. In other embodiments, each accommodating slot 11 is correspondingly provided with one supporting block 13.

As shown in FIG. 1 and FIG. 2, the lower surface of the insulating body 1 is provided with a plurality of legs 15 for supporting the circuit board 300. The legs 15 are located at a boundary of the lower surface of the insulating body 1.

As shown in FIG. 1, FIG. 6, and FIG. 7, the terminals 2 are correspondingly provided in the accommodating slots 11. Each terminal 2 has a first base 21 and a second base 22. The first base 21 and the second base 22 are flat plate shaped, and are located on different planes. The second base 22 bends and extends from one side of the first base 21 and forms an angle relative to the first base 21. In the present embodiment, the angle is approximately 90 degrees. A bending portion 23 is formed between the first base 21 and the second base 22. The first base 21 is correspondingly retained in the first groove 115. The other side of the first base 21 is provided with a first position limiting portion 211, which is limited by the first retention portion 116, so as to prevent the terminal 2 from excessively moving downward. The first base 21 has a retaining portion 212 located at a lower end thereof and extending downward. One side of the retaining portion 212 extends toward the second base 22 and forms a gap G relative to the bending portion 23 in the vertical direction. Two sides of the retaining portion 212 are provided with a plurality of clamping points 2121 for interference fit with the wall of the first groove 115 and the second slot wall 112, so as to retain the terminal 2 on the insulating body 1. The first base 21 has a connecting portion 213 located at an upper end thereof and extending upward. The connecting portion 213 slightly tilts to one side. A slot 2131 is provided on the connecting portion 213. A height of the slot 2131 in a vertical direction is not greater than one half of a height of the first base 21, and a horizontal plane where the lowest point of the slot 2131 in the vertical direction is located is lower than a horizontal plane where the upper end of the bending portion 23 is located. An elastic arm 24 bends and extends upward and forward from the connecting portion 213. The elastic arm 24 partially protrudes from the upper surface of the insulating body 1 and is located right above the corresponding protruding block 14 and at one side of the corresponding supporting block 13. A through slot 241 is provided on the elastic arm 24 in an extending direction thereof. The through slot 241 is communicated with the slot 2131, and the through slot 241 extends forward to be located right above the corresponding protruding block 14. The through slot 241 allows each terminal 2 and the chip module 200 to form a plurality of conductive paths, thus reducing self-inductance of the terminal 2 in signal transmission, and improving crosstalk, and thereby achieving transmission of high-frequency signals of the chip module 200. The elastic arm 24 has a contact portion 242 located at the extending tail end thereof. The contact portion 242 is used for being conductively connected with the chip module 200, and the through slot 241 does not penetrate through the contact portion 242. A side of the second base 22 away from the bending portion 23 is provided with a second position limiting portion 221. The second position limiting portion 221 is limited by the second retention portion 117, so as to prevent the terminal 2 from excessively moving downward.

Figure 5:
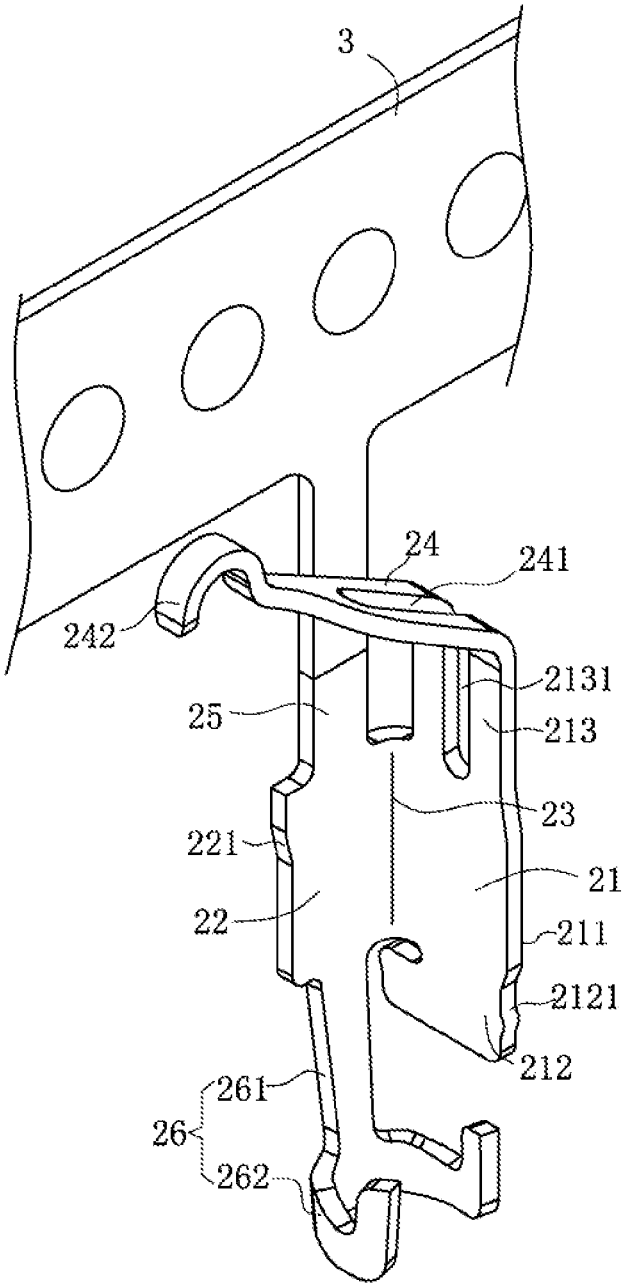
FIG. 5 is a perspective schematic view of a terminal connected to a strip in FIG. 1.

As shown in FIG. 4, FIG. 5, and FIG. 6, a strip connecting portion 25 extends upward from the second base 22 for connecting a strip 3. The strip connecting portion 25 is provided close to the supporting block 13, and the strip connecting portion 25 protrudes from the upper surface of the insulating body 1 and is flush with the top end of the protruding block 14. A conducting portion 26 extends downward from the second base 22 for being conductively connected with the circuit board 300. The conducting portion 26 and the first base 21 are located at the same side of a plane where the second base 22 is located. The conducting portion 26 has a flexible arm 261 extending downward obliquely from the second base 22 along a straight line, and a soldering portion 262 formed at the tail end of the flexible arm 261. The flexible arm 261 has a straight flat plate shaped structure. The reserved slot 118 provides an elastic deformation space for the flexible arm 261. The soldering portion 262 is provided with two clamping portions (unlabeled) for clamping a solder ball 4. In other embodiments, the first base 21 may also be a flat plate shaped structure or other feasible structures.

Figure 8:
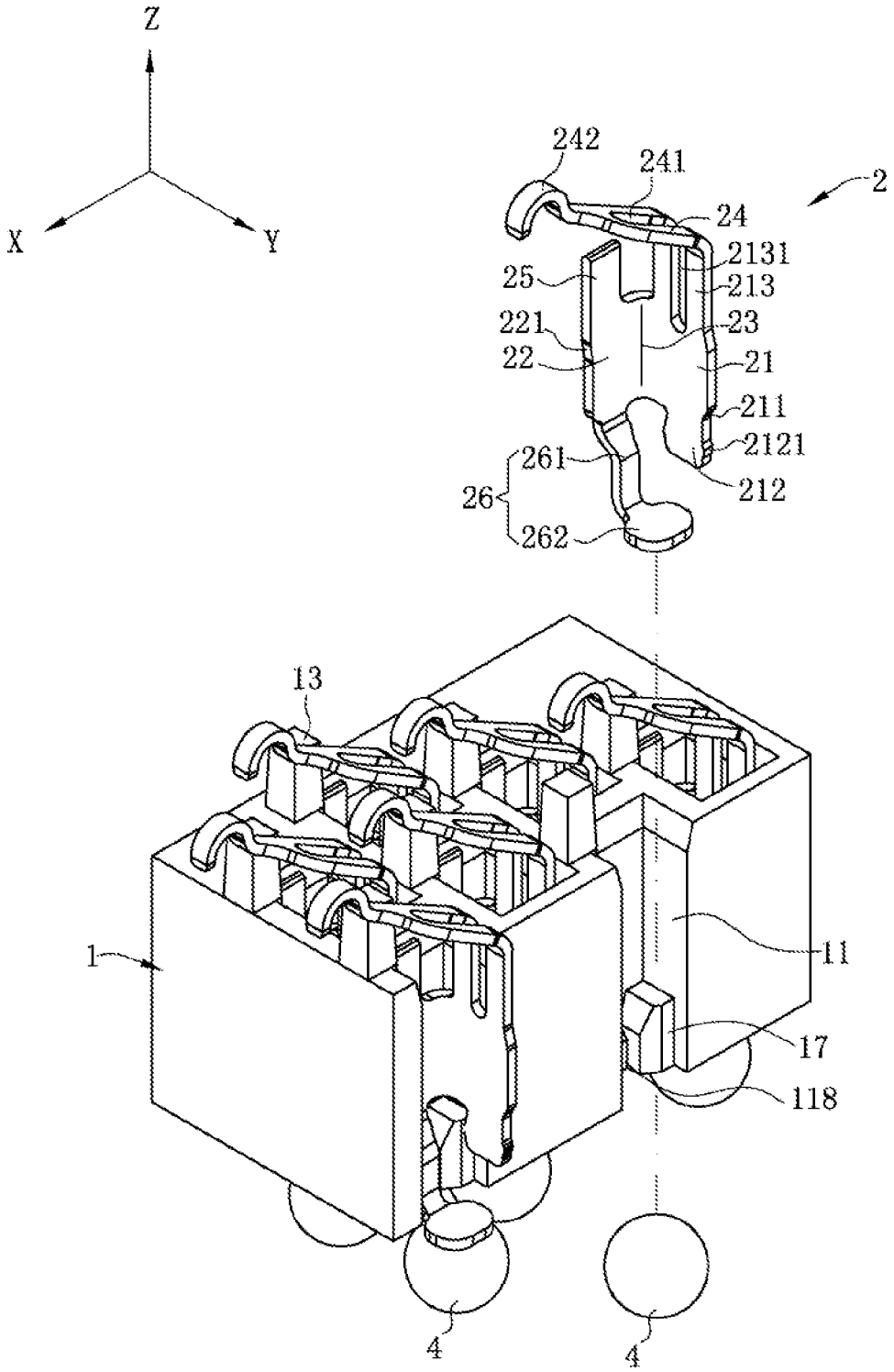
FIG. 8 is a perspective assembled sectional view of an electrical connector according to a second embodiment of the present invention.
Figure 9:
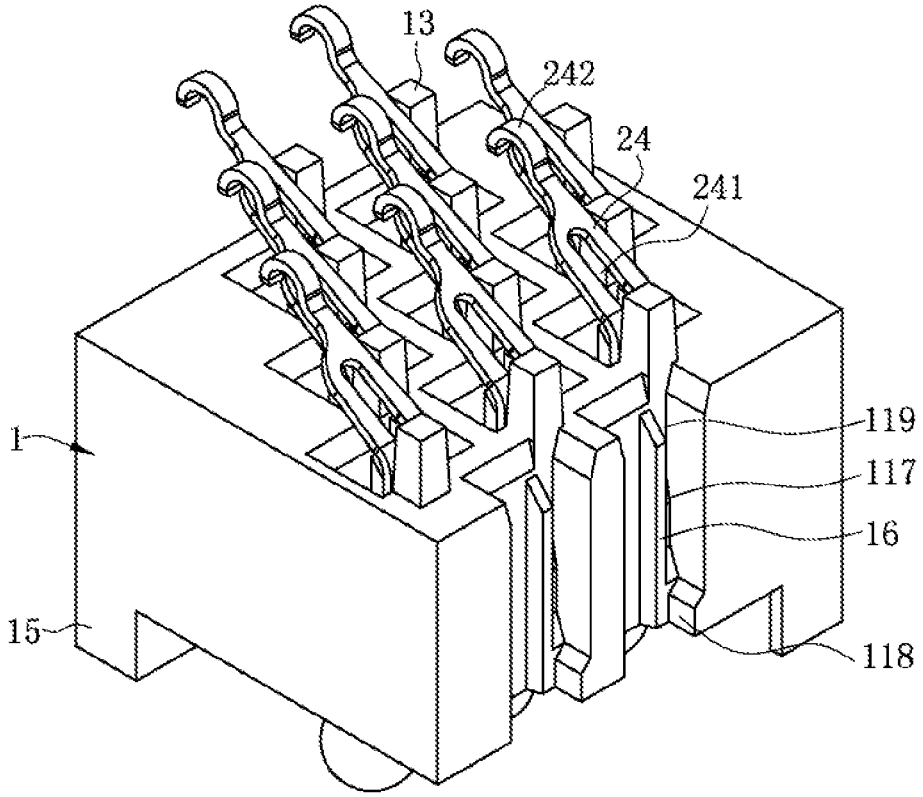
FIG. 9 is a perspective assembled sectional view of FIG. 8 from another perspective.
Figure 10:
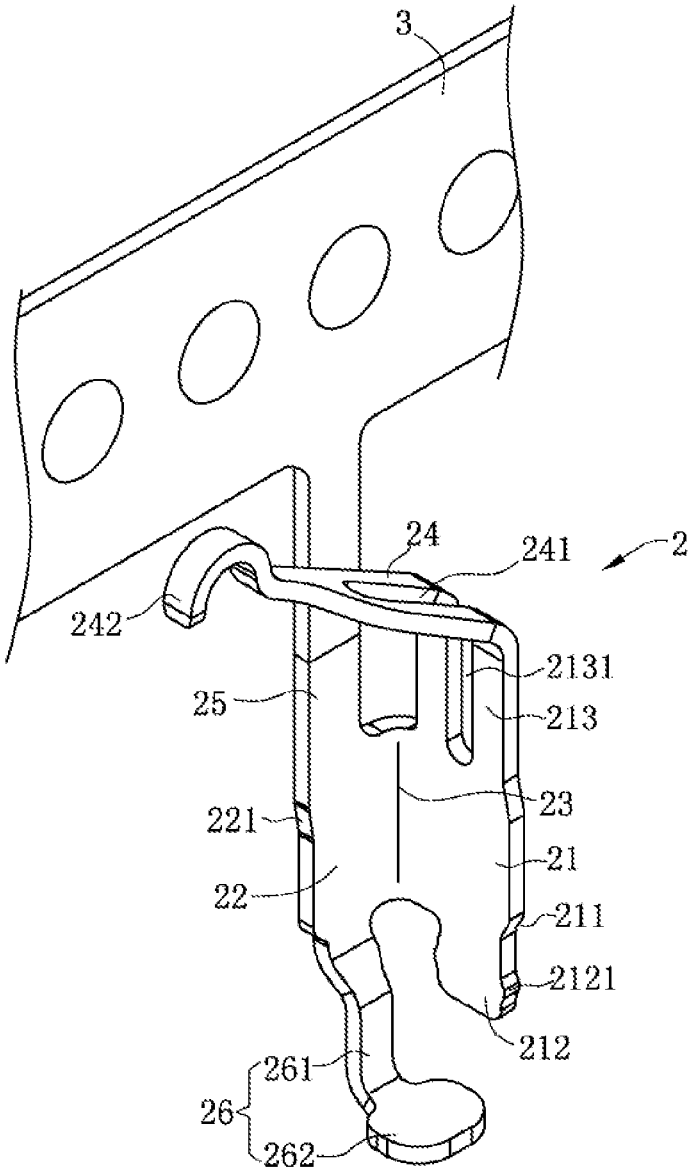
FIG. 10 is a perspective schematic view of a terminal connected to a strip in FIG. 8.
Figure 11:
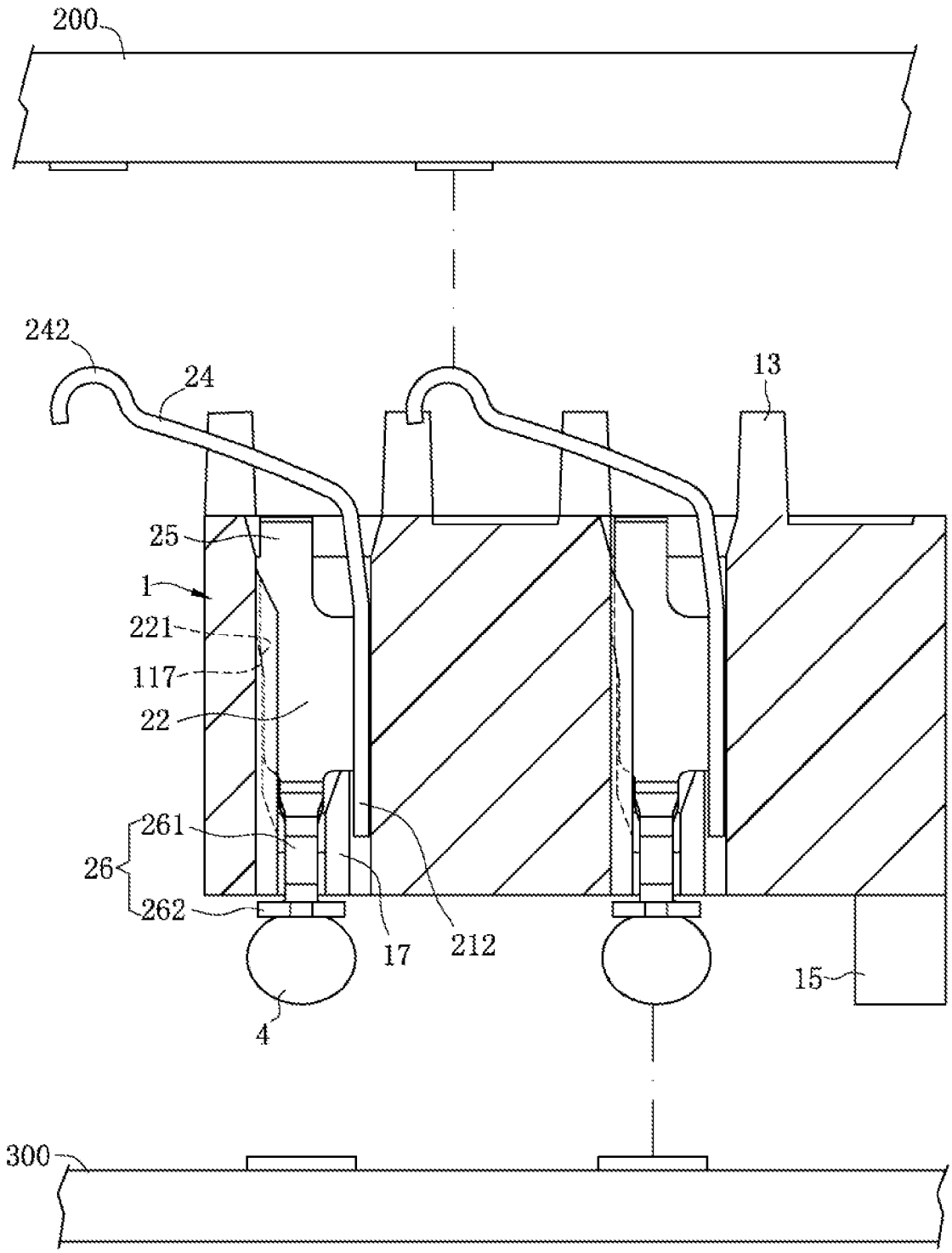
FIG. 11 is an exploded sectional view of an electrical connector for connecting a chip module and a circuit board in FIG. 8.
Figure 12:
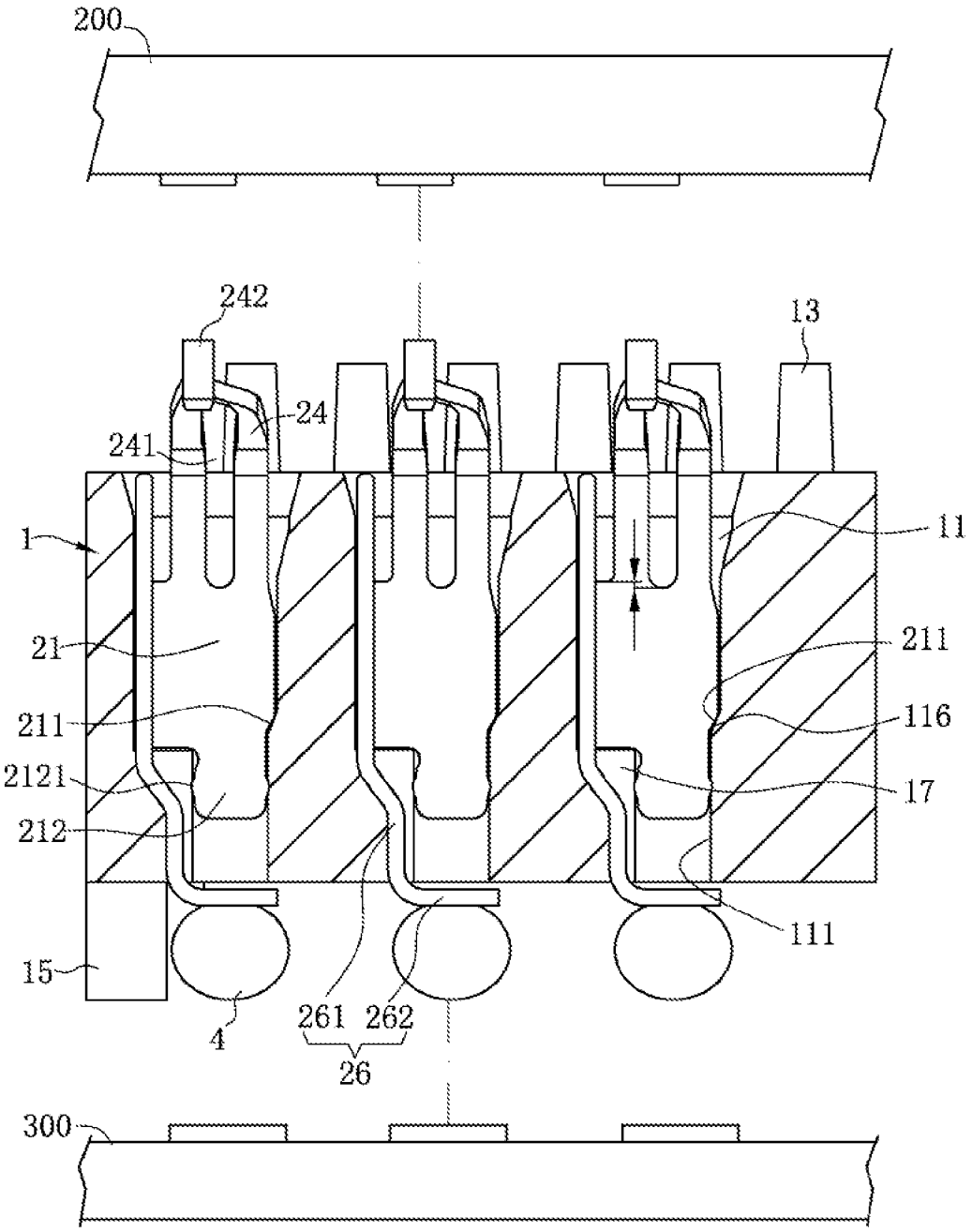
FIG. 12 is an exploded sectional view of FIG. 11 from another viewing angle.

FIG. 8 to FIG. 12 show an electrical connector according to a second embodiment of the present invention. The second embodiment is different from the first embodiment in that: as shown in FIG. 8, FIG. 9, and FIG. 12, each accommodating slot 11 has a first retention portion 116 formed on the first slot wall 111. The first retention portion 116 is adjacent to the third slot wall 113. The accommodating slot 11 has a rib 16 protruding from the fourth slot wall 114. A second groove 119 is formed between the rib 16 and the second slot wall 112, and the second groove 119 is adjacent to the second slot wall 112. A second retention portion 117 is formed on the wall of the second groove 119, and the rib 16 is partially located below the second groove 119. The insulating body 1 also has a stopping portion 17 protruding from the first wall 112 to the accommodating slot 11. The stopping portion 17 is connected to the third slot wall 113. The stopping portion 17 is located at the lower end of the accommodating slot 11. A reserved slot 118 is formed between the stopping portion 17 and the rib 16. The upper surface of the insulating body 1 is only provided with a plurality of supporting blocks 13 in an area corresponding to the terminal 2 for supporting the chip module 200.

As shown in FIG. 8 and FIG. 12, in the present embodiment, the bending portion 23 is stopped by the stopping portion 17 to prevent the terminal 2 from excessively moving downward. The first base 21 has a retaining portion 212 located at the lower end thereof and only extending downward, and the retaining portion 212 is retained between the stopping portion 17 and the first slot wall 111. The strip connecting portion 25 is flush with the upper surface of the insulating body 1. The flexible arm 261 firstly bends from the lower end of the second base 22 and then extends downward vertically. The portion of the flexible arm 261 vertically extending downward and the retaining portion 212 maintain an interval therebetween in a horizontal direction. The soldering portion 262 bends from the extending tail end of the flexible arm 261 and extends horizontally, and the soldering portion 262 has a flat plate shaped structure. The solder ball 4 is pre-soldered to the soldering portion 262. In other embodiments, the first base 21 may also be a flat plate shaped structure or other feasible structures.

Figure 13:
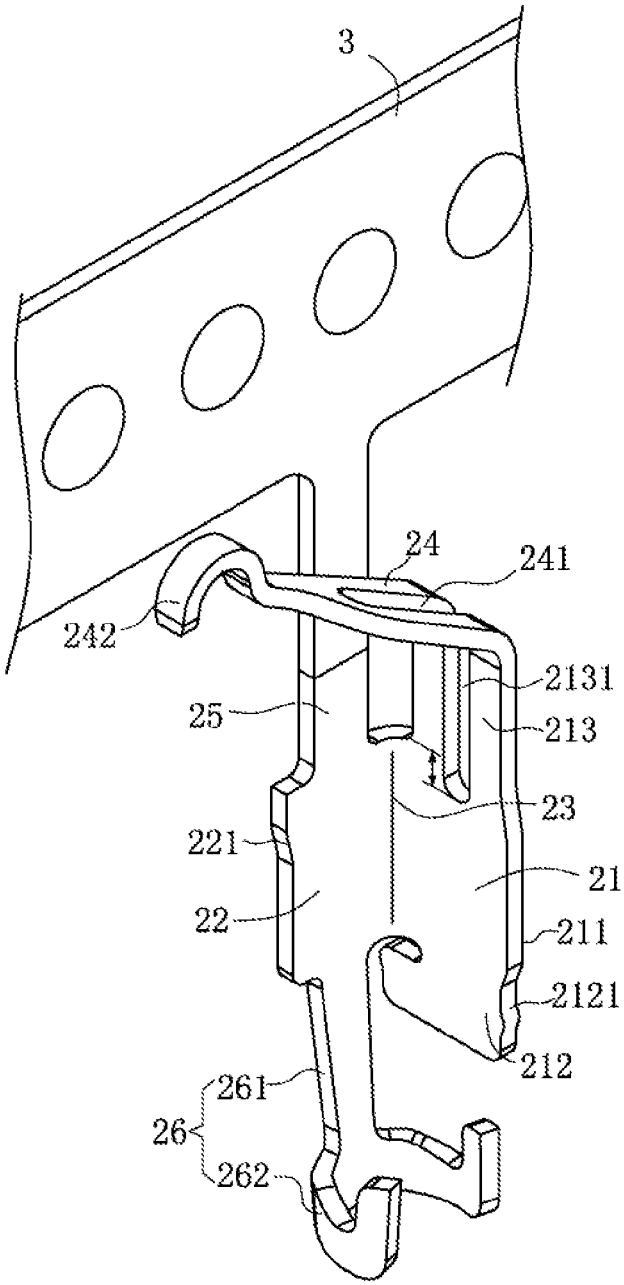
FIG. 13 is a perspective schematic view of a terminal connected to a strip according to a third embodiment of the present application.

FIG. 13 shows an electrical connector according to a third embodiment of the present invention. The third embodiment is different from the first embodiment in that the height of the slot 2131 in a vertical direction is greater than the height of the slot 2131 in a vertical direction in the first embodiment, but still is not greater than one half of the height of the first base 21. Other structures may be identical to those in the first embodiment.

Figure 14:
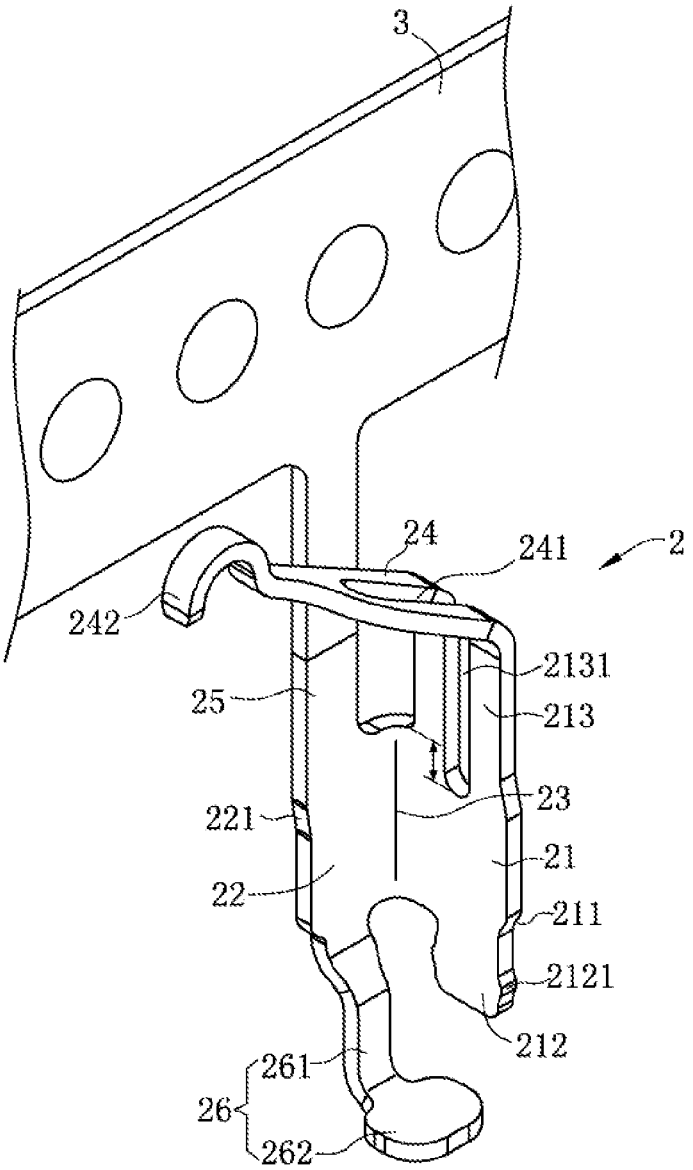
FIG. 14 is a perspective schematic view of a terminal connected to a strip according to a fourth embodiment of the present application.

FIG. 14 shows an electrical connector according to a fourth embodiment of the present invention. The fourth embodiment is different from the first embodiment in that: the height of the slot 2131 in a vertical direction is greater than the height of the slot 2131 in a vertical direction in the first embodiment, but still is not greater than one half of the height of the first base 21. Other structures may be identical to those in the second embodiment.

In the embodiments of the present invention, when the chip module 200 is installed on the electrical connector 100, the chip module 200 is in contact with the contact portion 242 and exerts a force on the elastic arm 24, such that the elastic arm 24 bends downward, and a downward action force will be inevitably exerted on the first base 21. Therefore, the retaining portion 212 is provided below the first base 21 connected to the elastic arm 24, and the retaining portion 212 is in interference fit with the wall of the accommodating slot 11. Compared with the structure described in the background, where the base is used for retaining the conductive terminal, the main body portion connected to the elastic arm is suspended, and the base is relatively distant from a vertical plane where the elastic arm are located, the movement of the elastic arm 24 in a left-right direction can be effectively reduced, thereby ensuring a stable electrical connection between the chip module 200 and the electrical connector 100.

To sum up, the electrical connector 100 according to certain embodiments of the present invention has the following beneficial effects:

(1) The elastic arm 24 extends upward from the first base 21, and the first base 21 has the retaining portion 212 located at the lower end thereof and extending downward. That is, the retaining portion 212 is provided on the first base 21 connected to the elastic arm 24, and the retaining portion 212 is in interference fit with the wall of the accommodating slot 11, thus preventing the first base 21 from being suspended, and effectively reducing shake of the elastic arm 24 in a left-right direction. When the chip module 200 presses against the contact portion 242 or an impact of an external force is caused when they are mated, a stable electrical connection between the terminal 2 and the chip module 200 can be ensured.

(2) A conducting portion 26 extends downward from the second base 22. The conducting portion 26 has a flexible arm 261 extending downward obliquely from the second base 22 along a straight line, and a soldering portion 262 formed at the tail end of the flexible arm 261. When the solder ball 4 is soldered to the circuit board 300, the flexible arm 261 provides flexibility, which may effectively prevent the occurrence of solder cracking caused by temperature change between the electrical connector 100 and the circuit board 300 before and after passing through a reflow furnace.

(3) A through slot 241 is provided between the elastic arms 24, so as to form a plurality of conductive paths between the terminal 2 and the chip module 200, thus reducing self-inductance of the terminal 2 in signal transmission, and improving crosstalk, and thereby achieving transmission of high-frequency signals of the chip module 200.

(4) The conducting portion 26 and the first base 21 are located at the same side of a plane where the second base 22 is located. Such an arrangement may effectively reduce space occupied by the terminal 2 in a horizontal direction, and the aperture of the accommodating slot 11 may also be correspondingly reduced, such that when the accommodating slot 11 is provided on the insulating body 1, the hollowing amount can be reduced, thereby ensuring the structural strength of the insulating body 1.

(5) The first base 21 has a connecting portion 213 and located at the upper end thereof. A slot 2131 is provided on the connecting portion 213, and a height of the slot 2131 in a vertical direction is not greater than one half of a height of the first base 21, such that the mechanical strength of the terminal 2 is ensured, the elasticity of the elastic arm 24 and the connecting portion 213 is increased, and the normal force of the chip module 200 during pressing downward is reduced. When the chip module 200 presses downward on the contact portion 242 of the elastic arm 24, the elastic arm 24 is more prone to deformation, preventing the elastic arm 24 from being damaged, thereby ensuring the stability of an electrical connection between the electrical connector 100 and the chip module 200.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, configured to electrically connecting a chip module to a circuit board, comprising:

an insulating body, provided with at least one accommodating slot; and at least one terminal, provided in the at least one accommodating slot, wherein the at least one terminal has a first base and a second base located at one side of the first base, the first base and the second base are located on different planes and form an angle therebetween, the first base is in interference fit with the at least one accommodating slot to retain the at least one terminal in the insulating body, an elastic arm is formed by bending upward and extending from the first base, the elastic arm is provided with a contact portion configured to be conductively connected with the chip module, and a conducting portion extends downward from the second base to be conductively connected with the circuit board, wherein the first base has a retaining portion located at a lower end thereof, the retaining portion is configured to retain the at least one terminal in the at least one accommodating slot, the conducting portion has a flexible arm extending from a lower end of the second base and a soldering portion extending from a tail end of the flexible arm, the conducting portion and the first base are located at a same side of a plane where the second base is located, the soldering portion is pre-filled with a solder, the insulating body is provided with a stopping block formed in the at least one accommodating slot and protruding toward the at least one accommodating slot, the stopping block is configured to stop the solder from moving upward, and the stopping block is provided to directly face the flexible arm in a horizontal direction.

2. The electrical connector according to claim 1, wherein the flexible arm extends downward obliquely from the second base along a straight line.

3. The electrical connector according to claim 1, wherein each of a side edge of the first base and a side edge of the second base is respectively provided with a position limiting portion, the at least one accommodating slot is correspondingly provided with a retention portion corresponding to each of the position limiting portions, and the retention portions are configured to stop the position limiting portions and to prevent the at least one terminal from moving downward.

4. The electrical connector according to claim 1, wherein a strip connecting portion is formed by extending upward from the second base and is configured to be connected to a strip, an upper surface of the insulating body is provided with at least one supporting block configured to support the chip module, and the supporting block is located at one side of the at least one accommodating slot and close to the strip connecting portion.

5. The electrical connector according to claim 1, wherein a reserved slot is concavely provided on the at least one accommodating slot to provide an elastic deformation space for the conducting portion.

6. The electrical connector according to claim 1, wherein the first base has a connecting portion located at an upper end thereof, the connecting portion is provided with a slot, and a height of the slot in a vertical direction is not greater than one half of a height of the first base.

7. An electrical connector, configured to electrically connecting a chip module to a circuit board, comprising:

an insulating body, provided with at least one accommodating slot; and at least one terminal, provided in the at least one accommodating slot, wherein the at least one terminal has a first base and a second base formed by bending from the first base, an elastic arm is formed by bending upward and extending from the first base, the elastic arm is provided with a contact portion configured to be conductively connected with the chip module, the first base has a retaining portion located at a lower end thereof, the retaining portion fits with the at least one accommodating slot to retain the at least one terminal in the insulating body, and a conducting portion extends downward from the second base to be conductively connected with the circuit board, wherein a bending portion is formed between the first base and the second base, one side of the retaining portion extends toward the second base, and a gap is provided between the retaining portion and the bending portion in a vertical direction.

8. The electrical connector according to claim 7, wherein the first base has a connecting portion located at an upper end thereof, the connecting portion is provided with a slot, and a height of the slot in a vertical direction is not greater than one half of a height of the first base.

9. The electrical connector according to claim 7, wherein each of a side edge of the first base and a side edge of the second base is respectively provided with a position limiting portion, the at least one accommodating slot is correspondingly provided with a retention portion corresponding to each of the position limiting portions, and the retention portions are configured to stop the position limiting portions to prevent the at least one terminal from moving downward.

10. The electrical connector according to claim 7, wherein the insulating body is provided with a stopping portion formed in the at least one accommodating slot and protruding toward the at least one accommodating slot, and the stopping portion is configured to stop the bending portion and to prevent the at least one terminal from moving downward.

11. The electrical connector according to claim 10, wherein the retaining portion is retained between the stopping portion and a slot wall of the at least one accommodating slot.

12. The electrical connector according to claim 7, wherein the conducting portion has a flexible arm extending from a lower end of the second base and a soldering portion extending from a tail end of the flexible arm, the conducting portion and the first base are located at a same side of a plane where the second base is located, and the flexible arm extends downward obliquely from the second base along a straight line.

13. The electrical connector according to claim 7, wherein the conducting portion has a flexible arm extending from a lower end of the second base and a soldering portion extending from a tail end of the flexible arm, the conducting portion and the first base are located at a same side of a plane where the second base is located, the soldering portion is pre-filled with a solder, the insulating body is provided with a stopping block formed in the at least one accommodating slot and protruding toward the at least one accommodating slot, the stopping block is configured to stop the solder from moving upward, and the stopping block is provided to directly face the flexible arm in a horizontal direction.

14. The electrical connector according to claim 7, wherein a strip connecting portion is formed by extending upward from the second base and is configured to be connected to a strip, an upper surface of the insulating body is provided with at least one supporting block configured to support the chip module, and the supporting block is located at one side of the at least one accommodating slot and close to the strip connecting portion.

15. The electrical connector according to claim 7, wherein a reserved slot is concavely provided on the at least one accommodating slot to provide an elastic deformation space for the conducting portion.

16. An electrical connector, configured to electrically connecting a chip module to a circuit board, comprising:

an insulating body, provided with at least one accommodating slot; and at least one terminal, provided in the at least one accommodating slot, wherein the at least one terminal has a first base and a second base formed by bending from the first base, an elastic arm is formed by bending upward and extending from the first base, the elastic arm is provided with a contact portion configured to be conductively connected with the chip module, the first base has a retaining portion located at a lower end thereof, the retaining portion fits with the at least one accommodating slot to retain the at least one terminal in the insulating body, and a conducting portion extends downward from the second base to be conductively connected with the circuit board, wherein the at least one accommodating slot has a first groove, a slot wall of the at least one accommodating slot is protrudingly provided with a rib, a second groove is formed between the rib and an adjacent slot wall of the at least one accommodating slot, the retaining portion is retained in the first groove, and the second base is retained in the second groove.

17. The electrical connector according to claim 16, wherein the conducting portion has a flexible arm extending from a lower end of the second base and a soldering portion extending from a tail end of the flexible arm, and the conducting portion and the first base are located at a same side of a plane where the second base is located.

18. The electrical connector according to claim 17, wherein the flexible arm bends from the lower end of the second base and then extends downward vertically, and the flexible arm and the retaining portion maintain an interval therebetween in a horizontal direction.

19. The electrical connector according to claim 16, wherein the first base has a connecting portion located at an upper end thereof, the connecting portion is provided with a slot, and a height of the slot in a vertical direction is not greater than one half of a height of the first base.

20. The electrical connector according to claim 16, wherein each of a side edge of the first base and a side edge of the second base is respectively provided with a position limiting portion, the at least one accommodating slot is correspondingly provided with a retention portion corresponding to each of the position limiting portions, and the retention portions are configured to stop the position limiting portions to prevent the at least one terminal from moving downward.

* * * * *